US005145433A

United States Patent [19]

Yagi et al.

[11] Patent Number: 5,145,433

[45] Date of Patent: Sep. 8, 1992

[54] HIGH TENSION CABLE DEVICE AND PROCESS OF PRODUCING THE SAME

[75] Inventors: Kiyoshi Yagi; Seiichi Wakabayashi, both of Gotenba, Japan

[73] Assignee: Yazaki Corporation, Tokyo, Japan

[21] Appl. No.: 548,532

[22] Filed: Jul. 5, 1990

[30] Foreign Application Priority Data

| | | | |
|---|---|---|---|
| Jul. 14, 1989 | [JP] | Japan | 1-082244[U] |
| Jul. 14, 1989 | [JP] | Japan | 1-180489 |
| Jul. 14, 1989 | [JP] | Japan | 1-180490 |
| Jul. 25, 1989 | [JP] | Japan | 1-086514[U] |
| Aug. 2, 1989 | [JP] | Japan | 1-090420[U] |
| Aug. 4, 1989 | [JP] | Japan | 1-201285 |

[51] Int. Cl.[5] ..... H01T 13/04

[52] U.S. Cl. ..... 445/7; 313/135; 313/313; 264/272.16; 439/126; 29/856; 445/22

[58] Field of Search ..... 445/7, 22; 264/272.13, 264/272.14, 272.15, 272.16, 272.18; 313/313, 135; 439/125, 126; 29/855, 856

[56] References Cited

U.S. PATENT DOCUMENTS

| | | | |
|---|---|---|---|
| 2,683,767 | 7/1954 | Cunningham | 264/272.16 X |
| 3,259,680 | 7/1966 | Schelke | 264/275 |
| 3,742,280 | 6/1973 | Siegle | 313/135 X |
| 3,803,529 | 4/1974 | Rohrig et al. | 439/125 X |
| 3,995,813 | 11/1976 | Lechner et al. | 313/124 |

FOREIGN PATENT DOCUMENTS

| | | | |
|---|---|---|---|
| 362777 | 4/1990 | European Pat. Off. | 313/135 |
| 2142554 | 8/1971 | Fed. Rep. of Germany . | |
| 3023288 | 1/1982 | Fed. Rep. of Germany . | |
| 3302878 | 8/1984 | Fed. Rep. of Germany . | |
| 1100894 | 9/1955 | France | 313/135 |
| 51-32180 | 9/1976 | Japan . | |
| 1296195 | 11/1972 | United Kingdom . | |
| 1395139 | 12/1972 | United Kingdom . | |
| 1570125 | 3/1977 | United Kingdom . | |
| 1494135 | 12/1977 | United Kingdom . | |

*Primary Examiner*—Kenneth J. Ramsey
*Attorney, Agent, or Firm*—Nikaido, Marmelstein Murray & Oram

[57] ABSTRACT

A high tension cable device with a series gap wherein an extraordinary discharge such as a creeping discharge which may occur along an outer face of a glass tube of a discharge tube is prevented effectively and a process of producing the same are disclosed. The high tension cable device comprises an electrically insulating tubular casing and a connecting terminal for the connection to a terminal of an ignition plug of an engine. The connecting terminal is fixedly fitted in the inside of an end portion of the casing, and a high tension cable is fitted in the other end portion of the casing. An additional function part such as a discharge tube for the formation of a series gap is mounted in the inside of the casing and coupled at an end thereof to the connecting terminal and at the other end thereof to the high tension cable, and an electrically insulating resin material is filled in a spacing in the inside of the casing.

7 Claims, 7 Drawing Sheets

HIGH TENSION CABLE DEVICE AND PROCESS OF PRODUCING THE SAME

BACKGROUND OF THE INVENTION

1. Field of the Invention

This invention relates to a high tension cable device and a process of producing the same, and more particularly to a high tension cable device suitable for use with an ignition system with a series gap for an automobile engine or the like and a process of producing the same.

2. Description of the Prior Art

Ignition systems for an automobile engine or the like are constituted such that a high voltage is applied to an ignition plug to produce a spark. As one of such ignition systems, an ignition system with a so-called series gap has been proposed wherein a discharge gap is provided in series to an ignition plug in order to prevent occurrence of smoke upon ignition and control the ignition timing accurately.

Such ignition system with a series gap is disclosed, for example, in Japanese Utility Model Laid-Open No. 63-101486 and is shown in FIG. 7. Referring to FIG. 7, the ignition system shown includes an ignition plug A screwed, for example, in a cylinder head B of an engine, and a high tension cable device C removably fitted on the ignition plug A. The high tension cable device C includes a high tension cable 3 and a plug cap 6 connected to an end of the high tension cable 3. The plug cap 6 includes a connecting terminal 2 for the connection to a terminal 1 of the ignition plug A, and a cable terminal 4 coupled to the end of the high tension cable 3. The connecting terminal 2 and cable terminal 4 are disposed, for example, in a substantially tubular casing 5 in an opposing spaced relationship from each other in a longitudinal direction of the casing 5. Though not particularly shown, the casing 5 is composed of a first casing in which the connecting terminal 2 is mounted and a second casing in which the cable terminal 4 is mounted.

A discharge tube 10 is mounted between the connecting terminal 2 and the cable terminal 4 in the plug cap 6 such that an outer periphery thereof closely contacts with an inner periphery of the casing 5. The discharge tube 10 includes a pair of discharge electrodes 7 and 8 sealed in a glass tube 9 in such a manner as to form a series gap S therebetween. The discharge electrodes 7 and 8 of the discharge tube 10 are fitted in and electrically connected to the connecting terminal 2 and cable terminal 4 of the casing 5, respectively.

A discharge tube for use with such an ignition system with a series gap is required to have a somewhat higher starting voltage than that of an ignition plug in order to control the ignition timing accurately. However, where a discharge tube having a high starting voltage is used, a so-called creeping discharge likely occurs along an outer face of the discharge tube prior to starting of a discharge at the series gap. Accordingly, it is very difficult to miniaturize a discharge tube itself while a high starting voltage is assured, and also it is difficult to miniaturize a plug cap of a high tension cable device.

Meanwhile, since the high tension cable device C described above is mounted on an engine, various vibrations of the engine and so forth are transmitted directly to the high tension cable device C. Where the glass tube 9 of the discharge tube 10 is fitted directly in the casing 5 of the plug cap 6 as described above, such external vibrations are transmitted directly to the discharge tube 10 and may possibly cause damage to the discharge tube 10. Further, since the discharge electrodes 7 and 8 of the discharge tube 10 and the terminals 2 and 4 in the casing 5 are respectively communicated with each other through mere fitting contact between them, there is the possibility that an instantaneous disconnection arising from incomplete contact between those members may be caused by such transmission of external vibrations to the discharge tube 10 as described above.

Another high tension cable device for use with an ignition system is also known wherein a discharge tube is mounted in a plug cap such that an outer periphery thereof is spaced from an inner periphery of a casing of the plug cap. A high tension cable device of the type just mentioned is shown in FIG. 8. Referring to FIG. 8, the high tension cable device also generally denoted at C is substantially similar in construction to the high tension cable device C shown in FIG. 7 except that the discharge tube 10 is fitted in the plug cap 6 with an air gap 11 left between an outer periphery of the glass tube 9 of the discharge tube 10 and an inner periphery of the casing 5. In the high tension cable device C, the discharge tube 10 is supported only at the discharge electrodes 7 and 8 thereof which have electrode terminals 7*a* and 8*a* fitted in and connected to the terminals 2 and 4 fitted in the casing 5.

While the air gap 11 is shown in a somewhat exaggerated manner in FIG. 8, a similar air gap is inevitably formed more or less also between the outer periphery of the glass tube 9 of the discharge tube 10 and the inner periphery of the casing 5 of the high tension cable device C shown in FIG. 7. Where such air gap 11 exists, a creeping discharge likely occurs along the outer face of the discharge tube 10 prior to starting of discharging between the electrodes 7 and 8. Then, once such creeping discharge occurs, a required starting voltage cannot be obtained any more, and there is a problem that the ignition timing and so forth cannot be controlled precisely.

SUMMARY OF THE INVENTION

It is an object of the present invention to provide a high tension cable device with a series gap wherein an extraordinary discharge such as a creeping discharge which may occur along an outer face of a glass tube of a discharge tube is prevented to allow the starting voltage of the discharge tube to be raised sufficiently high to assure a high reliability.

It is another object of the present invention to provide a high tension cable device which prevents damage to a discharge tube built in a plug cap which may arise from external vibrations and besides can prevent incomplete contact between the discharge tube and a plug cap side terminal.

It is a further object of the present invention to provide a process of producing a high tension cable device with a series gap which does not suffer from an extraordinary discharge of a discharge tube and is high in reliability.

In order to attain the objects, according to an aspect of the present invention, there is provided a high tension cable device which comprises an electrically insulating tubular casing, a connecting terminal for the connection to a terminal of an ignition plug, the connecting terminal being fixedly fitted in the inside of an end portion of the casing, a high tension cable fitted in the other end portion of the casing, an additional function part such as a discharge tube for the formation of a series gap mounted in the inside of the casing and coupled at one end thereof to the connecting terminal and at the other end thereof to the high tension cable, and an electrically insulating resin material filled in a spacing in the inside of the casing.

The additional function part may be, in addition to a discharge tube for the formation of a series gap which has a high discharge voltage characteristic, a resistor for the prevention of generation of noises, or a spacer made of an electrically insulating resin and mounted on an outer periphery of such additional function part for maintaining a distance between the outer face of the part and an inner face of the casing, or a connector for the connection of those parts.

Meanwhile, the electrically insulating resin material filled in the spacing in the inside of the casing left around the connecting terminal or the additional function part is preferably a thermosetting synthetic resin which is in the form of liquid when it is to be filled into the cable device so that it may flow even into a fine gap but it cures by a cross linking reaction after then. Preferably, such synthetic resin is, for example, an adhesive silicone resin, particularly a silicone resin of the addition reaction type in the form of liquid.

With the high tension cable device, a high tension current supplied by way of the end portion of the high tension cable all flows through the inside of the additional function part such as a discharge tube to the connecting terminal for the connection to an ignition plug, and a creeping discharge or the like will not occur along the outer face of the additional function part. Besides, the high tension cable device is tough against vibrations and is high in reliability.

According to the present invention, the high tension cable device is produced by a process which comprises the steps of preparing an electrically insulating tubular casing having a connecting terminal fixedly fitted in the inside of an end portion thereof, the connecting terminal being provided for the connection to an ignition plug, assembling an additional function part such as a discharge tube for the formation of a series gap into the electrically insulating tubular casing until the additional function part is connected to an end of the connecting terminal, filling a spacing formed between the tubular casing and the connecting terminal and additional function part with an electrically insulating resin material except a power supply side terminal portion of the additional function part, and connecting a high tension cable to the power supply side terminal of the additional function part.

Or alternatively, the high tension cable device may be produced by another process which comprises the steps of preparing an electrically insulating tubular casing having a connecting terminal fixedly fitted in the inside of an end portion thereof, the connecting terminal being provided for the connection to an ignition plug, assembling an additional function part such as a discharge tube for the formation of a series gap into the electrically insulating tubular casing until the additional function part is connected to an end of the connecting terminal, filling part of a spacing formed between the tubular casing and the connecting terminal and additional function part with an electrically insulating resin material to partially fix the additional function part to the tubular casing while the additional function part is held by means of a jig such that the additional function part may not contact with an inner periphery of the tubular casing, removing the jig, filling the remaining part of the spacing with a similar electrically insulating resin material except a power supply side terminal portion of the additional function part, and connecting a high tension cable to the power supply side terminal of the additional function part.

The high tension cable device may otherwise be produced by a further process which the steps of preparing an electrically insulating tubular casing having a connecting terminal fixedly fitted in the inside of an end portion thereof, the connecting terminal being provided for the connection of the high tension cable device to an ignition plug, the connecting terminal having a passage hole formed therein, the connecting terminal further having a check valve mechanism provided in the passage hole thereof for permitting only passage of fluid from an end to the other end of the connecting terminal, assembling an additional function part such as a discharge tube for the formation of a series gap into the electrically insulating tubular casing until the additional function part is connected to the other end of the connecting terminal, connecting a high tension cable to the opposite power supply side terminal portion of the additional function part, fitting a head cap at the opposite end of the tubular casing, the head cap having an air discharging hole formed therein, holding the casing in a vertical position such that the head cap is positioned upwardly, filling a spacing formed between the tubular casing and the connecting terminal and additional function part with an electrically insulating thermosetting resin material by way of the passage hole until the spacing is filled up, and heating the tubular casing to cause the resin material to cure.

According to another aspect of the present invention, there is provided a high tension cable device which comprises a connecting terminal for the connection to a terminal of an ignition plug, an additional function part such as a discharge tube for the formation of a series gap coupled at an end thereof to the connecting terminal, a high tension cable having an end terminal at an end thereof and coupled at the end terminal thereof to the other end of the additional function part, and a molded resin body in which the connecting terminal, additional function part and end terminal are embedded.

The molded resin body for embedding therein those members connected in such a manner as described above may be of the thermosetting or thermoplastic type and may be any synthetic resin only if it has required characteristics as a component for the protection of a high tension cable device, that is, an electric insulation, a heat resisting property, an oil resistance, a flame retardancy, a sufficient mechanical strength and so forth. Such electrically insulating synthetic resin may be, for example, a polyolefine resin, a styrene-diene resin, an epoxy resin, a silicone resin or rubber, a fluorocarbon resin or rubber, an acrylic resin or rubber, a diene resin or rubber, or a polyether resin or rubber.

The mold which is used for such embedding with a resin may be any mold which is suitable for a molding method of a synthetic resin, and where, for example, injection molding is employed, a metal mold provided with cooling means is employed, but where transfer molding is employed, a metal mold provided with heating means is used. Or, where a mold pouring method is employed, preferably a mold provided with means for supplying heat or radiation energy is employed.

With the high tension cable device, a high tension current supplied by way of the end portion of the high tension cable all flows through the inside of the additional function part such as a discharge tube to the connecting terminal for the connection to an ignition plug, and a creeping discharge or the like will not occur. Besides, the high tension cable device is tough against vibrations and is high in reliability.

The high tension cable device is produced by a process which comprises the steps of connecting a connecting terminal provided for the connection to a terminal of an ignition plug, an additional function part such as a discharge tube for the formation of a series gap and an end terminal attached to a high tension cable in this order, placing the connecting terminal, additional function part and end terminal in position into a mold, pouring an electrically insulating synthetic resin into the mold to form a molded resin body in which the connecting terminal, additional function part and end terminal are embedded, and removing the molded resin body from the mold after having been cooled.

Preferably, the high tension cable device additionally comprises a coating of an electrically insulating synthetic resin provided on a selected one of the connecting terminal, additional function and end terminal such that the coating surrounds at least part of an outer periphery of the selected member except a connecting portion of the member to another one of the members.

Such high tension cable device is produced by a process which comprises the steps of providing a coating of an electrically insulating synthetic resin on a selected one of members including a connecting terminal provided for the connection to a terminal of an ignition plug, an additional function part such as a discharge tube for the formation of a series gap and an end terminal coupled to a high tension cable such that the coating surrounds at least part of an outer periphery of the selected member except a connecting portion of the member to another one of the members, connecting the connecting terminal, additional function part and end terminal in this order, placing the connecting terminal, additional function part and end terminal in position into a mold, pouring an electrically insulating synthetic resin into the mold to form a molded resin body in which the connecting terminal, additional function part and end terminal are embedded, and removing the molded resin body from the mold after having been cooled.

According to a further aspect of the present invention, there is provided a high tension cable device which comprises a tubular casing including a first casing member and a second casing member coupled to the first casing, a connecting terminal fitted in the first casing member for the connection to a terminal of an ignition plug, a high tension cable, a power supply terminal fitted in the second casing member and connected to the high tension cable, a discharge tube for the formation of a series gap fitted in the tubular casing, a pair of holding members made of an elastic material and fitted in the first casing member for holding the discharge tube at the opposite end portions such that an outer periphery of the discharge tube is spaced from an inner periphery of the tubular casing, and a pair of conductive coil springs disposed in a compressed condition between an electrode portion of the discharge tube and the connecting terminal and between the other electrode portion of the discharge tube and the power supply terminal.

With the high tension cable device, since the discharge tube is held at an intermediate location in the casing by the holding members made of an elastic substance such that the outer periphery thereof is spaced from the inner periphery of the tubular casing, external vibrations are absorbed by the elastic substance, and possible damage to the discharge tube by external vibrations can be prevented. Further, since the conductive springs are provided in a compressed condition between the electrode portions of the discharge tube and the tubular casing side terminals, possible incomplete contact and instantaneous disconnection between the discharge tube and the casing side terminals by external vibrations can be prevented.

According to a still further aspect of the present invention, there is provided a high tension cable device which comprises a tubular casing, a connecting terminal fitted in an end portion of the tubular casing for the connection to a terminal of an ignition plug, a high tension cable, a power supply terminal fitted in the other end portion of the tubular casing, a discharge tube fitted in the casing, the discharge tube including a tubular sealing tube and a pair of opposing electrodes disposed at the opposite longitudinal end of and sealed in the sealing tube, a pair of holding members made of an elastic material and fitted in the tubular casing for surrounding and holding outer peripheries of the opposite end portions of the tubular sealing tube of the discharge tube such that an outer periphery of the discharge tube is spaced from an inner periphery of the tubular casing, and an adhesive electrically insulating material for sealing contact portions of the tubular sealing tube and the holding members.

With the high tension cable device, since the discharge tube is incorporated in the casing with the outer periphery of the sealing tube of the discharge tube partially held by the holding members and besides the contact portions of the sealing tube and the holding members are sealed with the electrically insulating material having an adhesive property, a creeping discharge which tends to occur along an outer face of the sealing tube can be prevented and the starting voltage of the discharge tube can be raised sufficiently high. Consequently, the ignition timing and so forth can be controlled precisely and the improvement in performance of an engine can be attained.

The above and other objects, features and advantages of the present invention will become apparent from the following description and the appended claims, taken in conjunction with the accompanying drawings in which like parts or elements having like functions are denoted by like reference characters all through the drawings.

DESCRIPTION OF THE PREFERRED EMBODIMENTS

Figure 1:
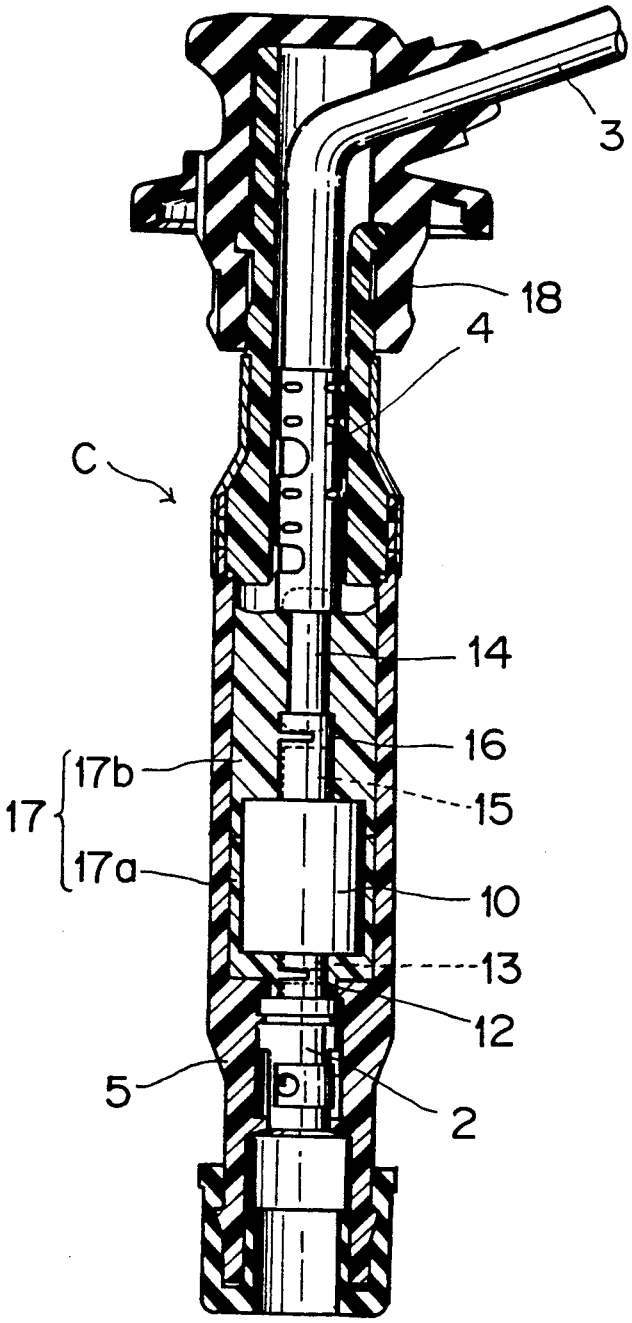
FIG. 1 is a sectional view of a high tension cable device showing a first embodiment of the present invention.

Referring first to FIG. 1, there is shown a high tension cable device to which the present invention is applied. The high tension cable device shown is generally denoted at C and includes a high tension cable 3 connected at an end thereof to a high voltage source not shown and a tubular casing 5 connected at an end portion thereof to the other end of the high tension cable 3. A connecting terminal 2 for the connection at an end thereof to an ignition plug (not shown) of an ignition system (not shown) is fitted in the other end portion of the casing 5. A female terminal 12 is formed at the end of the connecting terminal 2 and held in fitting engagement with a discharge electrode terminal 13 of a discharge tube 10. A resistor 14 is connected at an end thereof to the other discharge electrode terminal 15 of the discharge tube 10 by way of an intermediate connecting terminal 16 of the both end female type, and a cable terminal 4 is coupled to the end of the high tension cable 3 and fitted on and connected to the other end of the resistor 14. An electrically insulating silicone resin 17 is filled in any spacing which is formed between an inner face of the casing 5 and an outer face of any additional function part and so forth. The silicone resin 17 has a high adhesive property to a face of the casing 5 and faces of additional function parts accommodated in the casing 5 such as the connecting terminal 2, discharge tube 10, intermediate connecting terminal 16 and resistor 14.

The high tension cable device C is produced in the following manner. A discharge tube 10 is first inserted into a casing 5 having a connecting terminal 2 fitted in an end portion thereof until the discharge electrode terminal 13 of the discharge tube 10 is fitted into a female terminal 12 at the end of the connecting terminal 2. Then, the casing 5 is held in a vertical position such that the connecting terminal 2 may be positioned downwardly while the discharge tube 10 is supported using, in case of need, a jig such that it may be coaxial with the casing 5. While the casing 5 and the discharge tube 10 are held in such condition, an epoxy resin 17*a* in the form of liquid is poured into a spacing between the discharge tube 10 and the casing 5 until it is filled to a level a little below a shoulder or an upper end face of a body of the discharge tube 10. Then, a cross linking reaction takes place in the epoxy resin 17*a* to cause the epoxy resin 17*a* to cure to fix the discharge tube 10 in the casing 5. Subsequently, the jig is removed, and then, an assembly of an intermediate connecting terminal 16 of the both end female type and a resistor 14 coupled to the intermediate connecting terminal 16 is fitted onto the discharge electrode terminal 15 at the other end of the discharge tube 10. Then, while the resistor 14 is kept supported in position using, in case of need, another jig such that it may be coaxial with the casing 5, a similar epoxy resin 17*b* in the form of liguid is poured into the remaining hollow spacing in the casing 5 until it is fitted to a level just below an upper end terminal portion of the resistor 12. Then, a cross linking reaction takes place in the epoxy resin 17*b* to cause the epoxy resin 17*b* to cure to fix the discharge tube 10 in the casing 5. Consequently, the additional function parts including the discharge tube 10 are fixed in position in the casing 5 such that they are surrounded by or embedded in the synthetic resin filling 17 consisting of the synthetic resin fillings 17*a* and 17*b* as seen in FIG. 1. After then, a cable terminal 4 of a high tension cable 3 is coupled to the terminal portion at the top of the resistor 14 and a head cap 18 is mounted at the upper end of the casing 5, thereby completing assembly of a high tension cable device C.

In such process of producing the high tension cable device according to the present invention, the jig which is used to support such an additonal function part as the discharge tube 10 or the resistor 14 such that it may be coaxial with the casing 5 need not necessarily be used if the additional function part can be mounted in the casing 5 such that it may stand by itself, and an electrically insulating spacer may be provided around those additional function parts such that the additional function parts may be surrounded together with the spacer by an electrically insulating epoxy resin or the like.

Three high tension cable devices for the examination having such construction as described above were produced using discharge tubes having a starting voltage characteristic of 25 KV and three kinds of adhesive silicone resins (CY52-238, SE1885 and SE1886 produced by Toray Corporation) as electrically insulating resin materials. The high tension cable devices for the examination were connected to ignition plugs each grounded at the opposite pole thereof, and a positive voltage of 30 KV was applied at a frequency of 50 Hz from the power supply side terminals of the high tension cables to effect an endurance test for 96 hours. Then, a result of the endurance test was compared with a result of a similar endurance test conducted with conventional high tension cable devices for the comparison wherein no electrically insulating resin material was filled. While outer faces of the discharge tubes of the devices for the comparison suffered from damages due to creeping discharges, no occurrence of such creeping discharge was recognized with the high tension cable devices of the present invention wherein a silicon resin was filled.

Figure 2:
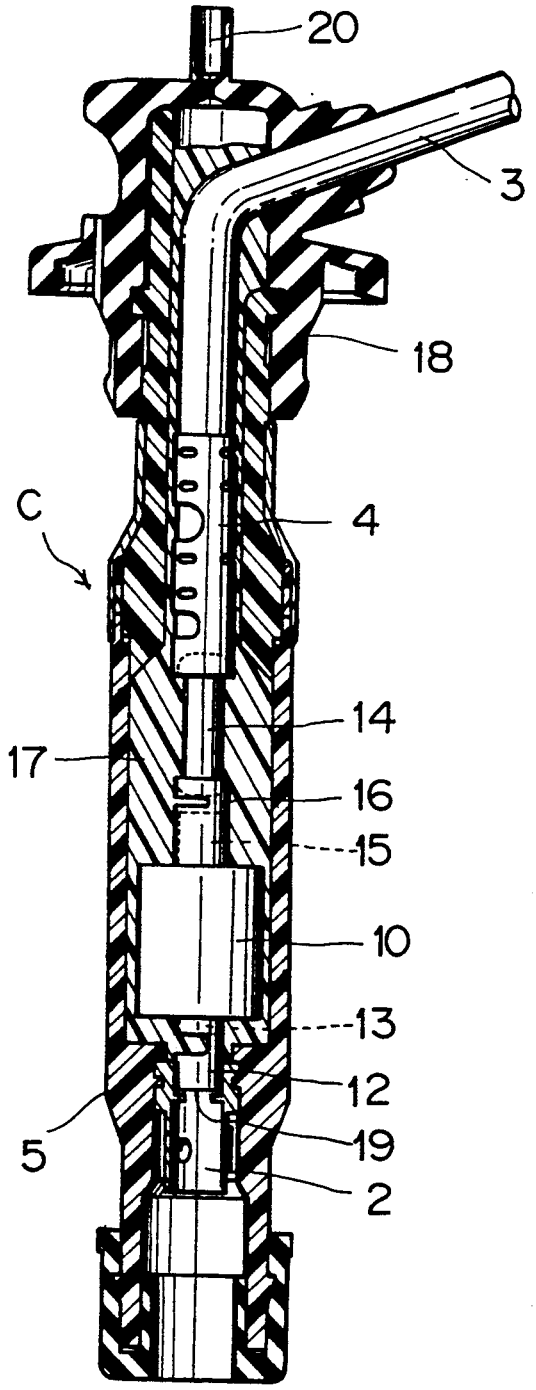
FIG. 2 is a sectional view of a high tension cable device showing a second embodiment of the present invention.

Referring now to FIG. 2, there is shown a high tension cable device according to a second embodiment of the present invention. The high tension cable device C shown has a substantially similar construction to that of the high tension cable device C shown in FIG. 1 except that the connecting terminal for the connection to an ignition plug and the head cap 18 are different in structure and the electrically insulating epoxy resin 17 is filled in a different manner in the casing 5. In particular, a check valve 19 is mounted at an intermediate portion of the connecting terminal 2 in such a manner as to partition a spacing which is formed in and extends axially through the inside of the connecting terminal 2.

Meanwhile, the electrically insulating epoxy resin 17 is filled in a spacing which is formed between inner faces of the casing 5 and head cap 18 and outer faces the connecting terminal 2, discharge tube 10, intermediate connecting terminal 16, resistor 14 and so forth in the casing 5. It is to be noted here that the electrically insulating epoxy resin 17 is formed as a single filling which surrounds and fixes those additional function parts in the casing 5.

According to the present invention, the high tension cable device C shown in FIG. 2 is produced in the following manner. In particular, a discharge tube 10 is first inserted into a casing 5 having a connecting terminal 2 fitted in an end portion thereof until a discharge electrode terminal 13 of the discharge tube 10 is fitted into a female terminal 12 at an end of the connecting terminal 2, and an assembly of an intermediate connecting terminal 16 of the both end female type and a resistor 14 coupled to the connecting terminal 16 is fitted into the other discharge electrode terminal 15 at the other end of the discharge tube 10 such that the discharge tube 10 and the resistor 14 may be coaxial with the casing 5, whereafter a cable terminal 4 of a high tension cable 3 is coupled to a terminal portion at the other of the resistor 14 and a head cap 18 is mounted onto the casing 5 to assemble a high tension cable device C.

After then, the assembly of the high tension cable device C is held in a vertical position such that the connecting terminal 2 may be positioned downwardly while the head cap 13 is positioned upwardly, and a thermosetting synthetic resin such as, for example, an epoxy resin, in the form of liquid is poured into the assembly of the high tension cable device C by way of a check valve 19 of the connecting terminal 2. The liquid resin is gradually filled into a hollow spacing in the casing 5 from the bottom of the assembly of the high tension cable device C until the level of the filling resin comes to at least such a degree at which the additional function parts including the discharge tube 10 are surrounded fully by the liquid resin. After then, the liquid resin may further be filled into a hollow spacing in the head cap 18. In order to allow air to be discharged from the spacings in the casing 5 and head cap 18, the head can 18 has a passage hole 20 formed in an end wall thereof. The liquid resin filled in the high tension cable device C in this manner is then hardened by a cross linking reaction under a suitable hardening reaction temperature condition, thereby completing the high tension cable device C.

Figure 3:
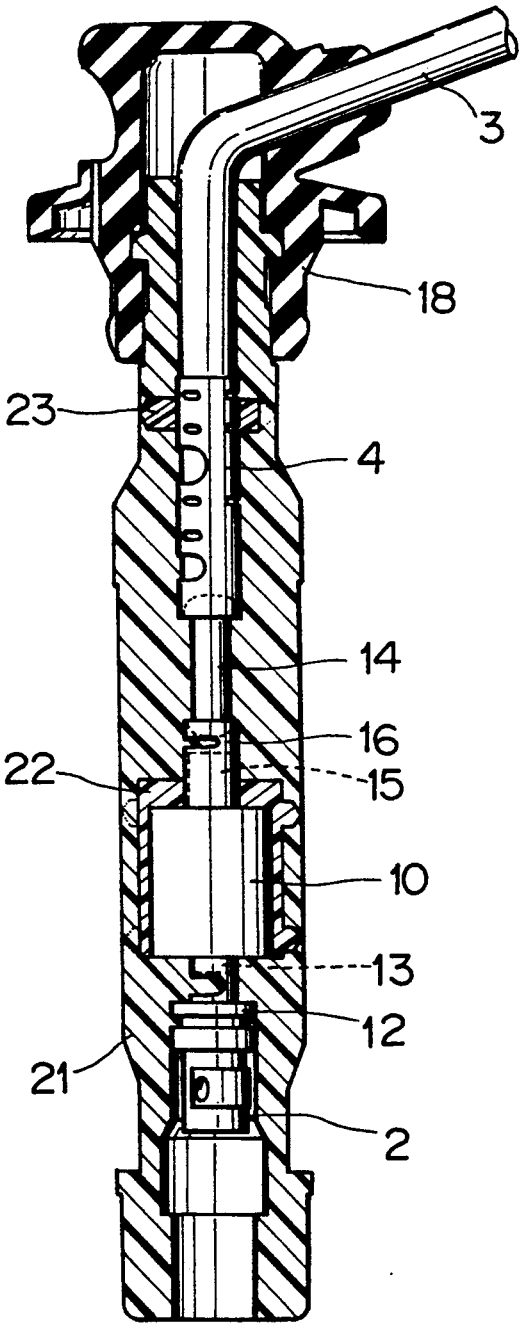
FIG. 3 is a sectional view of a high tension cable device showing a third embodiment of the present invention.

Referring now to FIG. 3, there is shown a high tension cable device according to a third embodiment of the present invention. The high tension cable device C includes a high tension cable 3 and a molded resin body 21 connected at an end portion thereof to an end of the high tension cable 3 and serving as a casing. A connecting terminal 2 is fitted in the other end portion of the molded resin body 21. A female terminal 12 is formed at the end of the connecting terminal 2 and held in fitting engagement with a discharge electrode terminal 13 of a discharge tube 10. A resistor 14 is connected at an end thereof to the other discharge electrode terminal 15 of the discharge tube 10 by way of an intermediate connecting terminal 16 of the both end female type, and a cable terminal 4 is coupled to the end of the high tension cable 3 and fitted on and connected to the other end of the resistor 14. The connecting terminal 2, discharge tube 10, resistor 14, intermediate connecting terminal 16, cable terminal 16 and an end portion of the high tension cable 3 are embedded in the molded body 21 of a silicone resin having a generally post-like shape and fixed substantially along an axial line of the resin molded body 21.

According to the present invention, the high tension cable device C is produced in the following manner. In particular, an assmebly of an intermediate connecting terminal 16 connected to the discharge electrode terminal 15 of a discharge tube 10 is mounted into a metal mold for the injection molding, and an insulating coating 22 of a polypropylene resin which is to serve also as a spacer is formed on an outer periphery and an end face of the discharge tube 10 adjacent the electrode terminal 15 by insert molding as seen in FIG. 3. Further, an annular spacer 23 is prepared separately for the positioning of a cable terminal 4 substantially along an axial line of a resin molded body 13.

A connecting terminal 2 for the connection to an ignition plug not shown, the assembly of the discharge tube 10 and the intermediate connecting terminal 16, and the resistor 14 are connected successively to each other and mounted into another mold separately prepared for the molding of a high tension cable device. Then, a high tension cable 3 having the annular spacer 23 fitted on the cable terminal 4 thereon is connected to a terminal portion at the other end of the resistor 14 to assemble those members such that all of them may be alined in position on an axial line of the mold. Subsequently, the mold is closed and a silicone resin of the addition reaction type is poured into the mold, whereafter the resin is heated so as to cure, thereby forming a molded resin body 21 which surrounds those members.

A molded article obtained in this manner is removed from the mold after it becomes cool, and a head cap 18 is mounted onto the molded article, thereby completing a high tension cable device C.

Figure 4:
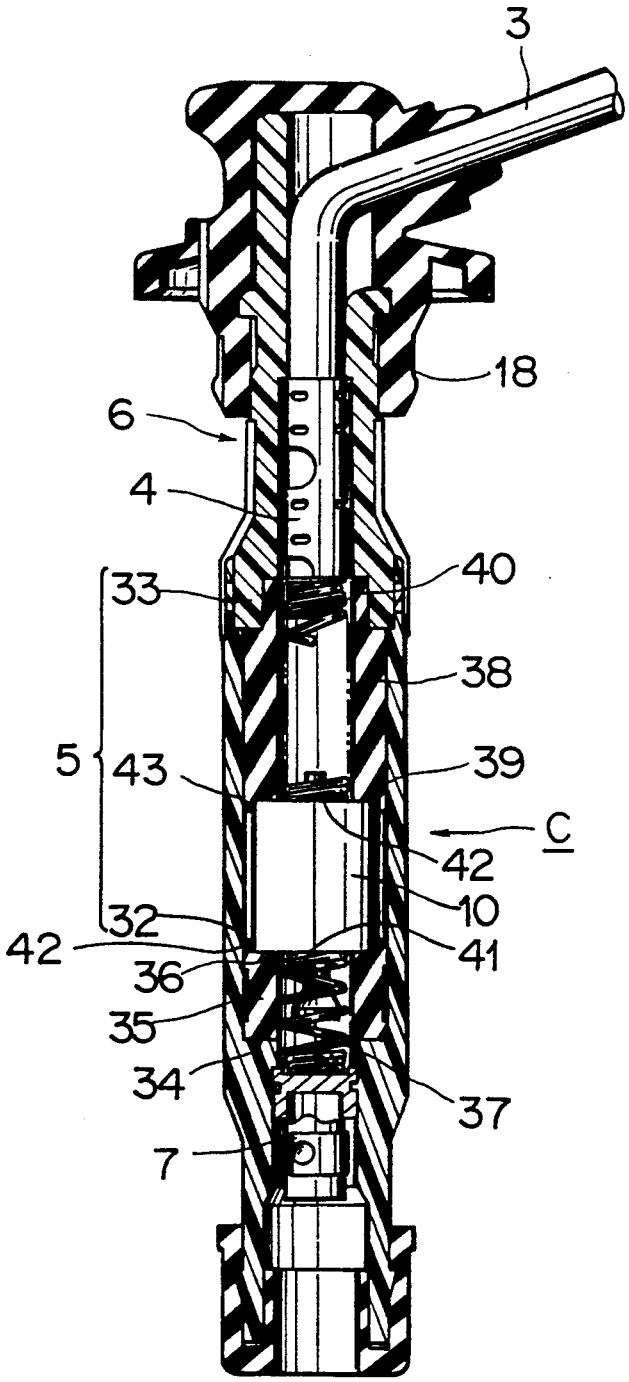
FIG. 4 is a sectional view of a high tension cable device showing a fourth embodiment of the present invention.

Referring now to FIG. 4, there is shown a high tension cable device according to a fourth embodiment of the present invention. The high tension cable device C includes a high tension cable 3 and a tubular casing 5 of a plug cap 6 connected at an end portion thereof to an end of the high tension cable 3. The tubular casing 5 consists of a first casing 32 in which a connecting terminal 2 for the connection to a terminal of an ignition plug not shown is fitted and a second casing 33 which is assembled to the first casing 32 and in which a power supply terminal or cable terminal 4 connected to the high tension cable 3 is fitted. A discharge tube 10 which forms a series gap is incorporated in the tubular casing 5.

A stepped portion or shoulder 34 is formed on an inner periphery of the first casing 32 adjacent the connecting terminal 2, and a substantially tubular holding member 35 made of an elastic substance such as rubber is fitted in the first casing 32 and placed on the stepped portion 34 of the first casing 32. A receiving stepped portion 36 is formed on an inner periphery at the opposite axial end portion of the holding member 35 in such a manner as to form an axial tubular extension 42. An end portion of the discharge tube 10 having an outer diameter smaller than an inner diameter of the first casing 32 is thus fitted in the extension 42 of the holding member 35 while the stepped portion 36 is held in contact with an axial end face of the discharge tube 10. A conductive coil spring 37 is interposed in a compressed condition between an axial end face of the discharge tube 10 and the connecting terminal 2 and extends through the holding member 35. The conductive coil spring 37 is fitted in closely contracting relationship around and electrically connected to a discharge electrode terminal 41 of the discharge tube 10.

Another substantially tubular holding member 38 made of an elastic substance such as rubber is fitted in the first casing 32 and has a receiving stepped portion 39 formed on an inner periphery of an end portion thereof in such a manner as to form an axial tubular extension 43. The extension 43 of the holding member 38 is fitted on the other end portion of the discharge tube 10, and the receiving stepped portion 39 of the holding member 38 is held in contact with the other axial end face of the discharge tube 10. Another conductive coil spring 40 is interposed in a compressed condition between the other end face of the discharge tube 10 and the power supply terminal 4 and extends through the holding member 38. The conductive coil spring 40 is fitted in a closely contacting relationship around and electrically connected to the other discharge electrode terminal 42 of the discharge tube 10.

If the several parts are assembled in such a predetermined order as described above into the first casing 32 and then the second casing 33 is assembled to the first casing 32, then the discharge tube 10 is accommodated into the first casing 32 such that an outer periphery thereof is spaced from an inner periphery of the first casing 32 while the conducting springs 37 and 40 are accommodated in a compressed condition between the opposite axial end faces of the discharge tube 10 and the terminals 2 and 4, respectively.

Finally, a head cap 18 is assembled to the end portion of the casing 5 adjacent the high tension cable 3 in order to prevent water or some other foreign substance from entering the plug cap 5 after the high tension cable device C is assembled.

With the high tension cable device C of the embodiment shown in FIG. 4, since the opposite ends of the discharge tube 10 in the longitudinal direction are held by the holding members 35 and 38 made of an elastic substance and fitted in the first casing 32, the discharge tube 10 can be held in the first casing 32 such that the outer periphery thereof is spaced from the inner periphery of the first casing 32. Consequently, external vibrations of the engine and so forth are absorbed by the holding members 35 and 38, and accordingly, possible damage to the discharge tube 10 by vibrations can be prevented. Further, since the conductive springs 37 and 40 are interposed in a compressed condition between the discharge electrode terminals 41 and 42 of the discharge tube 10 and the terminals 2 and 4 and extend through the holding members 35 and 38, respectively, possible incomplete contact and instantaneous disconnection between the discharge tube 10 and the terminal 2 or 4 by external vibrations is prevented effectively. Further, since the opposite end portions of the discharge tube 10 are fitted in and held on the receiving stepped portions 36 and 39 of the holding members 35 and 38, the outer periphery of the discharge tube 10 incorporated in the first casing 32 is held spaced with certainty from the inner periphery of the first casing 32, and the discharge tube 10 can be positioned with certainty in the first casing 32.

Figure 5:
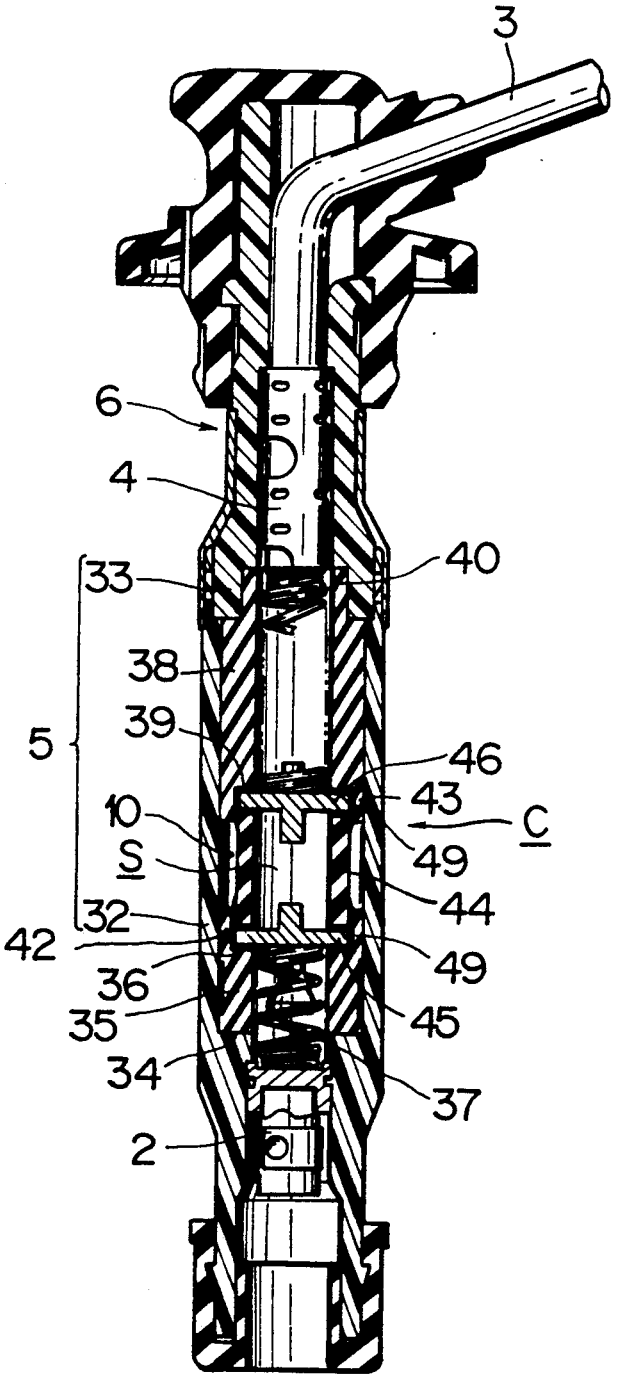
FIG. 5 is a sectional view of a high tension cable device showing a fifth embodiment of the present invention.
Figure 7:
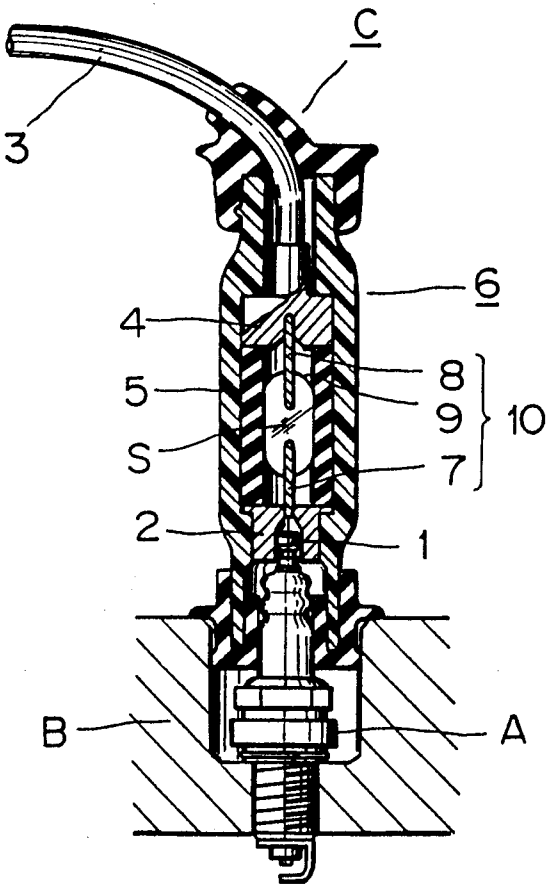
FIG. 7 PRIOR ART
FIG. 7 is a sectional view showing a conventional high tension cable device.
Figure 6:
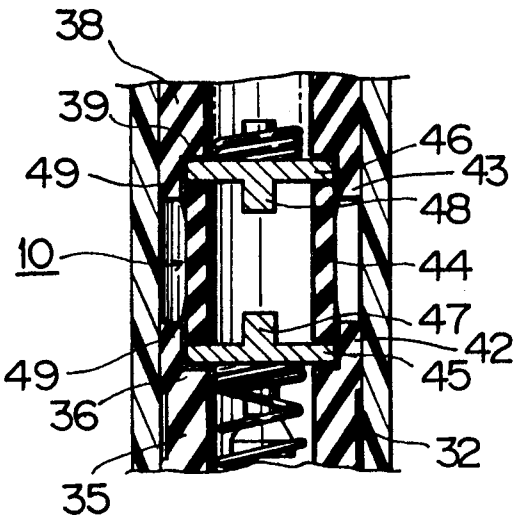
FIG. 6 is a partial enlarged view of the high tension cable device of FIG. 5.
Figure 8:
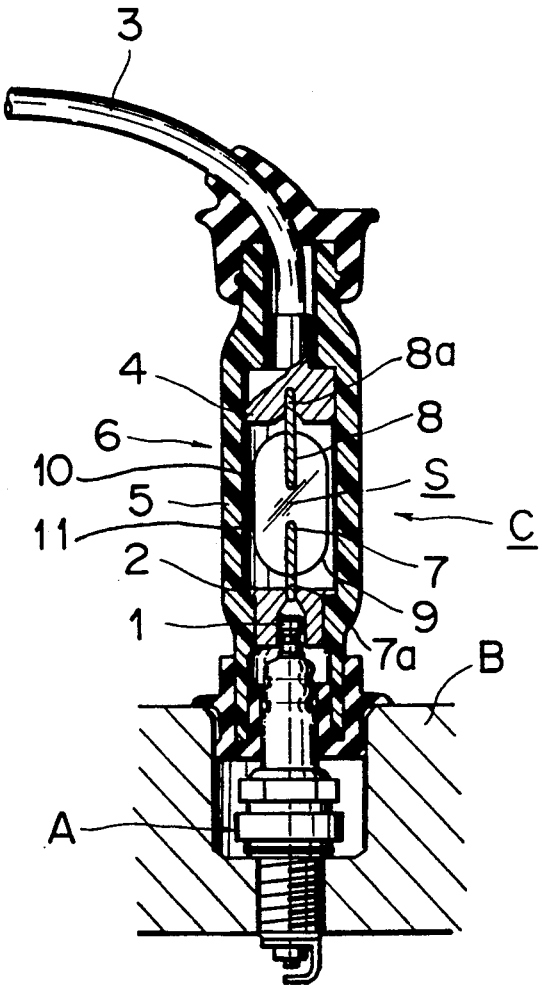
FIG. 8 PRIOR ART
FIG. 8 is a sectional view showing another conventional high tension cable device.

Referring now to FIGS. 5 and 6, there is shown a high tension cable according to a fifth embodiment of the present invention. The high tension cable device C of the present embodiment is substantially similar in construction to the high tension cable device C of the embodiment shown in FIG. 4 except that the axial tubular extensions 42 and 43 of the substantially tubular holding members 35 and 38 have a greater axial length so that they may cover over greater axial extents of outer peripheries of the discharge tube 10. In particular, as particularly seen in FIG. 6, the discharge tube 10 is of the type which includes an insulating tube 44 made of a ceramics material or the like and acting as a sealing tube and a pair of electrode plates 45 and 46 mounted on the opposite ends of the insulating tube 44 in such a manner as to close openings at the opposite ends of the insulating tube 44 in an airtight condition. The electrode plates 45 and 46 have discharging electrode portions 47 and 48 formed on opposing inner faces thereof, and suitable inert gas is enclosed in the insulating tube 44 in the thus sealed up condition.

The electrode plate 45 of the discharge tube 10 is fitted in the axial tubular extension 42 and held on the stepped portion 36 of the substantially tubular holding member 35 while the other electrode plate 46 is fitted in the axial tubular extension 43 and held on the stepped portion 39 of the other substantially tubular holding member 38. Where the discharge tube 10 is held in position in the first casing 32, the extensions 42 and 43 of the holding members 35 and 38 extend farther than the electrode plates 45 and 46, respectively, and fully cover over portions of an outer periphery adjacent the opposite ends of the insulating tube 44. In other words, the axial opposite end portions of the insulating tube 44 are fitted in the extensions 42, and 43 of the holding members 35 and 38.

Before the discharge tube 10 is assembled, an electrically insulating material 49 having an adhesive property such as, for example, an epoxy resin is applied to inner faces of the extensions 42 and 43 and the stepped portions 36 and 39 of the holding members 35 and 38. Consequently, when the discharge tube 10 is assembled, no air gap is left between the discharge tube 10 and the inner faces of the extensions 42 and 43 and the stepped portions 36 and 39 of the holding members 35 and 38 along which the discharge tube 10 is held on the holding members 35 and 38.

The high tension cable device C shown in FIGS. 5 and 6 present such similar advantages to those of the high tension cable device C shown in FIG. 4 as described hereinabove because they have substantially similar constructions as described above. Besides, due to the modified construction, the high tension cable device C is further advantageous in that, since the discharge tube 10 is disposed in the casing 5 such that the outer peripheries of the electrode plates 45 and 46 and the opposite end portions of the outer periphery of the insulating tube 44 adjacent the electrode plates 45 and 46 are held by the holding members 35 and 38 and besides each of contact portions of the discharge tube 10 and the holding members 35 and 36, particularly contact portions of the holding members 35 and 36 with the insulating tube 44 of the discharge tube 10, is sealed with the expoxy resin 19, a creeping discharge which tends to occur along the surface of the insulating tube 44 of the discharge tube 10 can be prevented, and the starting voltage of the discharge 10 can be raised sufficiently high. Consequently, the ignition timing and so forth can be controlled more precisely and the improvement in performance of an engine can be attained.

Having now fully described the invention, it will be apparent to one ordinary skill in the art that many changes and modifications can be made thereto without departing from the spirit and scope of the invention as set forth herein.

What is claimed is:

1. A high tension cable device comprising an electrically insulating tubular casing, a connecting terminal for the connection to a terminal of an ignition plug, said connecting terminal being fixedly fitted in the inside of an end portion of said casing, a high tension cable fitted in the other end portion of said casing, an additional function part mounted in the inside of said casing and coupled at one end thereof to said connecting terminal and at the other end thereof to said high tension cable, and an electrically insulating resin material filled in a spacing in the inside of said casing, said cable device further comprising a head cap mounted at the other end of said casing, and a check valve disposed intermediately in a hollow axial hole of said connecting terminal for allowing, when said electrically insulating resin material is to be fed into the inside of said casing by way of said hollow axial hole of said connecting terminal, such feeding of the resin material but preventing the resin material from coming out of the inside of said casing by way of said hollow axial hole of said connecting terminal, said electrically insulating resin material being filled fully in a spacing formed between said casing and head cap and said connecting terminal and additional function part.

2. A process of producing a high tension cable device, comprising the steps of preparing an electrically insulating tubular casing having a connecting terminal fixedly fitted in the inside of an end portion thereof, said connecting terminal being provided for the connection to an ignition plug, assembling an additional function part into said electrically insulating tubular casing until said additional function part is connected to an end of said connecting terminal, filling part of a spacing formed between said tubular casing and said connecting terminal and additional function part with an electrically insulating resin material to partially fix said additional function part to said tubular casing while said additional function part is held by means of a jig such that said additional function part may not contact with an inner periphery of said tubular casing, removing said jig, filling the remaining part of said spacing with a similar electrically insulating resin material except a power supply side terminal portion of said additional function part, and connecting a high tension cable to said power supply side terminal of said additional function part.

3. A process of producing a high tension cable device as claimed in claim 2, wherein the electrically insulating resin material is selected from thermosetting synthetic resins in the form of liquid.

4. A process of producing a high tension cable device, comprising the steps of preparing an electrically insulating tubular casing having a connecting terminal fixedly fitted in the inside of an end portion thereof, said connecting terminal being provided for the connection of said high tension cable device to an ignition plug, said connecting terminal having a passage hole formed therein, said connecting terminal further having a check valve mechanism provided in said passage hole thereof for permitting only passage of fluid from an end to the other end of said connecting terminal, assembling an additional function part into said electrically insulating tubular casing until said additional function part is connected to the other end of said connecting terminal, connecting a high tension cable to the opposite power supply side terminal portion of said additional function part, fitting a head cap at the opposite end of said tubular casing, said head cap having an air discharging hole formed therein, holding said casing in a vertical position such that said head cap is positioned upwardly, filling a spacing formed between said tubular casing and said connecting terminal and additional function part with an electrically insulating thermosetting resin material by way of said passage hole until said spacing is filled up, and heating said tubular casing to cause the resin material to cure.

5. A high tension cable device, comprising a tubular casing including a first casing member and a second casing member coupled to said first casing, a connecting terminal fitted in said first casing member for the connection to a terminal of an ignition plug, a high tension cable, a power supply terminal fitted in said second casing member and connected to said high tension cable, a discharge tube for the formation of a series gap fitted in said tubular casing, a pair of holding members made of an elastic material and fitted in said first casing member for holding said discharge tube at the opposite end portions such that an outer periphery of said discharge tube is spaced from an inner periphery of said tubular casing, and a pair of conductive coil springs disposed in a compressed condition between an electrode portion of said discharge tube and said connecting terminal and between the other electrode portion of said discharge tube and said power supply terminal.

6. A high tension cable device, comprising a tubular casing, a connecting terminal fitted in an end portion of said tubular casing for the connection to a terminal of an ignition plug, a high tension cable, a power supply terminal fitted in the other end portion of said tubular casing, a discharge tube fitted in said casing, said discharge tube including a tubular sealing tube and a pair of opposing electrodes disposed at the opposite longitudinal ends of and sealed in said sealing tube, a pair of holding members made of an elastic material and fitted in said tubular casing for surrounding and holding outer peripheries of the opposite end portions of said tubular sealing tube of said discharge tube such that an outer periphery of said discharge tube is spaced from an inner periphery of said tubular casing, and an adhesive electrically insulating material for sealing contact portions of said tubular sealing tube and said holding members.

7. A high tension cable device as claimed in claim 6, further comprising a pair of conductive coil springs disposed in a compressed condition between an electrode portion of said discharge tube and said connecting terminal and between the other electrode portion of said discharge tube and said power supply terminal.

* * * * *

UNITED STATES PATENT AND TRADEMARK OFFICE

CERTIFICATE OF CORRECTION

PATENT NO. : 5,145,433

DATED : September 8, 1992

INVENTOR(S) : Yagi et al

It is certified that error appears in the above-identified patent and that said Letters Patent is hereby corrected as shown below:

On the title page, item [75] Inventors:
Please correct the name of the city of the inventors' residence in Japan from "GOTENBA" to --SHIZUOKA--.

Signed and Sealed this

Twenty-eighth Day of September, 1993

Bruce Lehman

*Attest:*

BRUCE LEHMAN

*Attesting Officer*

*Commissioner of Patents and Trademarks*